US005996249A

United States Patent [19]

Manning

[11] Patent Number: 5,996,249

[45] Date of Patent: Dec. 7, 1999

[54] PORTABLE GARMENT DRYER WITH CARRYING CASE

[75] Inventor: Roberta J Manning, Louisville, Ky.

[73] Assignee: Synergist, LLC, Louisville, Ky.

[21] Appl. No.: 09/155,240

[22] PCT Filed: Apr. 28, 1997

[86] PCT No.: PCT/US97/07749

§ 371 Date: Sep. 22, 1998

§ 102(e) Date: Sep. 22, 1998

[87] PCT Pub. No.: WO97/41401

PCT Pub. Date: Nov. 6, 1997

Related U.S. Application Data

[63] Continuation-in-part of application No. 08/638,772, Apr. 29, 1996, Pat. No. 5,642,572.

[51] Int. Cl.[6] ..... F26B 9/00

[52] U.S. Cl. ..... 34/621; 34/622; 34/202

[58] Field of Search ..... 34/618, 619, 621, 34/622, 202, 218, 233, 235, 91

[56] References Cited

U.S. PATENT DOCUMENTS

| | | | |
|---|---|---|---|
| 3,264,755 | 8/1966 | Moore . | |
| 3,487,557 | 1/1970 | Linstead . | |
| 4,406,071 | 9/1983 | Buchman | 34/91 |
| 4,572,364 | 2/1986 | Jordan | 206/287 |
| 4,815,219 | 3/1989 | Binger | 34/91 |
| 5,323,897 | 6/1994 | Sperber | 206/287 |
| 5,388,344 | 2/1995 | Wallach | 34/91 |
| 5,528,840 | 6/1996 | Pajak et al. | 34/622 |
| 5,642,572 | 7/1997 | Manning | 34/621 |

*Primary Examiner*—Henry Bennett
*Assistant Examiner*—Pamela A. Wilson
*Attorney, Agent, or Firm*—Wheat, Smith & Beres, PLC; Vance A. Smith; David W. Nagle, Jr.

[57] ABSTRACT

The present invention pertains to a portable garment dryer having a support member (10, 14, 60) with a centrally located opening (26) on a top surface thereof. A light but durable, air permeable garment bag (18) is secured about the opening (26) on a bottom surface of the support member (10, 14, 60). An elastic member (28) circumscribes the opening (26) on the other side of the support member (10, 14, 60) and snugly receives a barrel of a hair dryer (22) in an air tight relationship. A pair of adjustable straps (20) are secured to the sides of the support member (10, 14, 60) and supports the support member (10, 14, 60) so that the garment bag hangs freely beneath the support member (10, 14, 60). A damp garment can be hung in the interior of the bag (18) and the hair dryer unit turned on. In a preferred embodiment, foldable flaps (16, 17) extend from the support member (14) to enclose the garment bag (18) folded tightly against the bottom surface of the support member (14) when the garment dryer is not in use.

5 Claims, 8 Drawing Sheets

PORTABLE GARMENT DRYER WITH CARRYING CASE

This application is a national filing of PCT/97/07749, filed Apr. 28, 1997, and is a continuation-in-part of commonly assigned U.S. application Ser. No. 08/638,772, filed Apr. 29, 1996, which issued as U.S. Pat. No. 5,642,572 on Jul. 1, 1997.

BACKGROUND OF THE INVENTION

The present invention pertains to a garment drying device and, more particularly, pertains to a portable garment drying device that uses a portable hair dryer unit to provide the hot drying air to the garment.

It is known to use a hair drying unit with a clothes drying bag to dry articles of clothing. U.S. Pat. No. 3,264,755 issued on Aug. 9, 1966 to A. S. Moore discloses the use of clothes drying bag with a hair drying unit. The bag is provided with a top opening through which the neck of a hanger may be inserted to hang the bag on a rod. Clothes to be dried then may be placed on the bow of the hanger in the interior of the bag. A bottom opening is adapted to receive a hose fitting for the hair dryer unit. Hot air is circulated upward and exits through openings 21 provided in the bag. It is noted that the bag set forth in the patent may be folded when not in use, but has no attached carrying case or covering. Moreover, it would appear that the dryer must be continuously attended during operation due to the bottom entry of the hair dryer unit into the bag.

Still another garment drying bag is disclosed in U.S. Pat. No. 4,572,364, issuing on Feb. 25, 1986 to W. T. Jordan, in which the garment bag, doubling as both a carrying bag and drying bag, is provided with an elasticized circular opening at the top for insertion of the barrel of a hair dryer unit. It is noteworthy that the hair dryer unit must be held by hand continuously when drying the clothes. Moreover the bag cannot be conveniently stored when not in use such as in another suitcase and is clearly not portable in the sense of this application.

It is a paramount object of the present invention to provide for a portable garment dryer in which the dryer has a self contained carrying case capable of being carried or placed in luggage or a purse.

It is another important object of the present invention to provide a portable garment dryer which is adaptable to various models of hair dryers and can support and stabilize the hair dryer unit in operation without continuous attendance of the user.

It is still another object of the present invention to minimize direct contact of the hair dryer unit with the garment bag and to provide for adaptive use of the portable garment dryer under varied conditions, including use with both shower curtain rods and available doors.

Other advantages of the present invention will become clear following a reading of the detailed description in connection with the various figures.

SUMMARY OF THE INVENTION

The portable garment dryer of the present invention has a substantially rigid support base that has a centrally located opening though which a barrel of a hair dryer may inserted. The opening is elasticized so that it can accept barrels of hair dryers of different dimensions. In one variation the opening is provided with a grommet-like member with inwardly directed, radial and segmented fingers, that are flexible, and abut the circumference of and provide support to the hair dryer unit. A pair of straps attached to the support base are used to hang the unit from a shower curtain rod or top edge of a door. A garment enclosing bag is mounted to the underneath surface of the base and communicates with the opening. When the support base is suspended from a support structure, the garment bag hangs free beneath the support base. A garment to be dried is placed into the bag when suspended and hung on a hanger inside of the bag. The barrel of the hair dryer unit is inserted into the opening and the unit is largely supported in that position by the grommet-like member. However, the straps also provided an abutting stabilizing relationship with the body of the dryer unit so that the reactive force generated by the jet of hot air from the dryer cannot substantially move the dryer unit from its position. The base support is also provided with flaps on all sides that enclose the bottom surface thereof when the dryer is not in use. The garment bag being constructed of a light but highly flexible material folds into an essentially flat configuration against the bottom surface and thus is covered by the flaps. The straps can also be shortened and wrapped about the base support to further secure the flaps and garment bag in the closed position.

DETAILED DESCRIPTION OF THE PREFERRED EMBODIMENT

Figure 1:
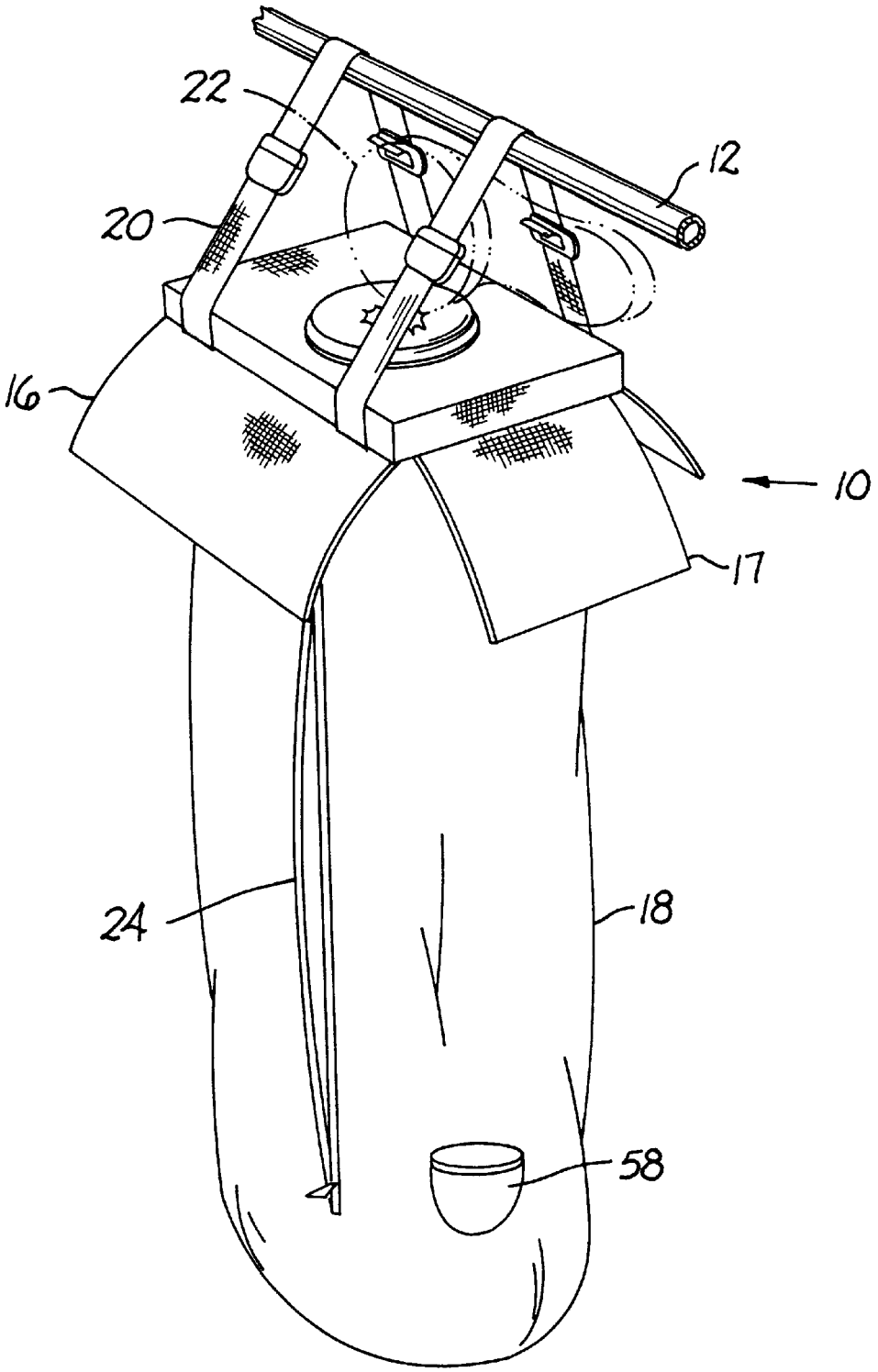
FIG. 1 is a perspective view of the portable garment dryer of the present invention hanging from a shower curtain rod or a closet pole with the hair dryer unit illustrated in phantom.

The hair dryer of the present invention, shown generally by the character numeral 10 hanging from a closet pole or a shower rod 12 in the perspective of FIG. 1, is comprised of the following major components: a central base member 14; two sets of flaps 16 and 17 extending from base member 14; a garment enclosing bag 18; and a set of straps 20 secured about the rod 12. A hair dryer unit 22 is depicted in phantom lines in place above base member 14. Garment bag 18 is attached to and extends below base member 14 and is further provided with a zipper 24 permitting access to the interior of bag 18 as desired.

Figure 2:
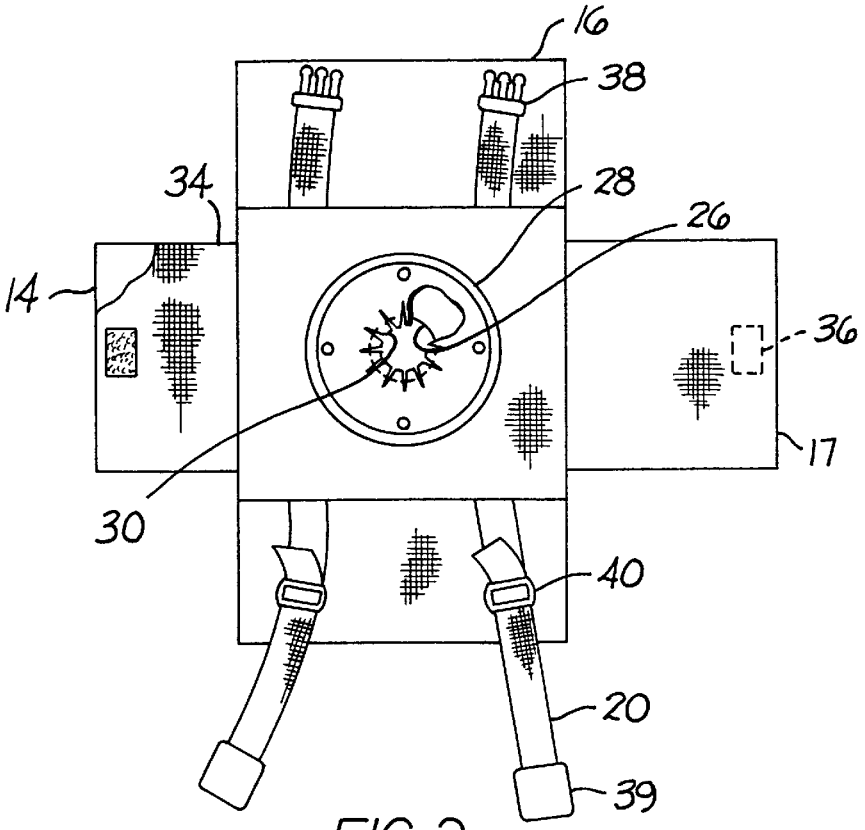
FIG. 2 is a top view of the portable garment dryer of the present invention before being attached to a support structure with the enclosure flaps shown in an open position.
Figure 4:
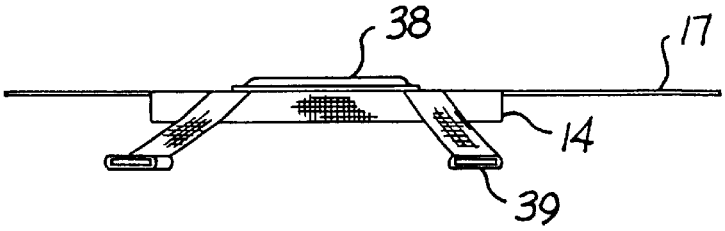
FIG. 4 is a side view of the dryer of FIG. 1 with the flaps in the closed position.

As perhaps best seen in the top view of FIG. 2 and side view of FIG. 4, base member 14 is a platen with a rectangular configuration and thin thickness. Preferably, the width and length of the member is between about 5 to 7 inches with the thickness preferably being less than about ¼ of an inch. It is desirable that base member 14 be light in weight and rigid enough to support the hair dryer unit and a garment to be dried without significant flexing. High density plastic materials, for example, a high density polyoefin, have been found suitable for the base member 14. Base member 14 further defines a centrally located circular opening 26 over which is positioned a grommet-like receiving member 28. Member 28 is secured to the top surface of member 14 and is made from a elastomeric material and shaped to have a multiplicity of segmented and flexible fingers 30 extending radially toward the center of member 28, defining an opening 32. The member 28 receives the barrel 22*a* of the hair drying unit 22 and the fingers 30 flex and abut the barrel, providing a support for hair dryer unit 22 as illustrated in FIG. 5.

Figure 3:
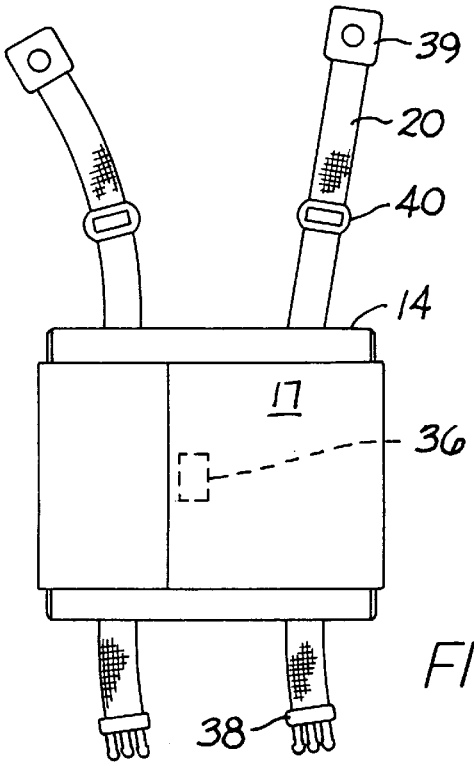
FIG. 3 is a bottom view of the dryer of FIG. 2 with the flaps in the closed position.

Returning to the top view of FIG. 2 and the bottom view of the base member 14 of FIG. 3, it may be seen that the base 14 is covered with a fabric 34. Flaps 16 and 17 may be extensions of fabric 34 and fold under base 14. Flaps 16, the under flaps, are dimensioned to completely cover the underside of base 14 while the over flaps 17 are dimensioned to overlap slightly when folded and have hook and loop fasteners 36 and 37 to secure the flaps in place. Straps 20 may be stitched directly to fabric 34 or secured directly to base 14. Straps 20 are fastened together by finger lock fasteners 38 and 39 and the length thereof adjusted by use of adjustable buckles 40. When the flaps 16 and 17 are secured in place as illustrated in FIG. 3, straps 20 may be shortened to closely conform to the shape of member 14 when wrapped around it and fastened. This provides additional securement of the flaps and also provides a convenient handle to carry the dryer 10.

Figure 5:
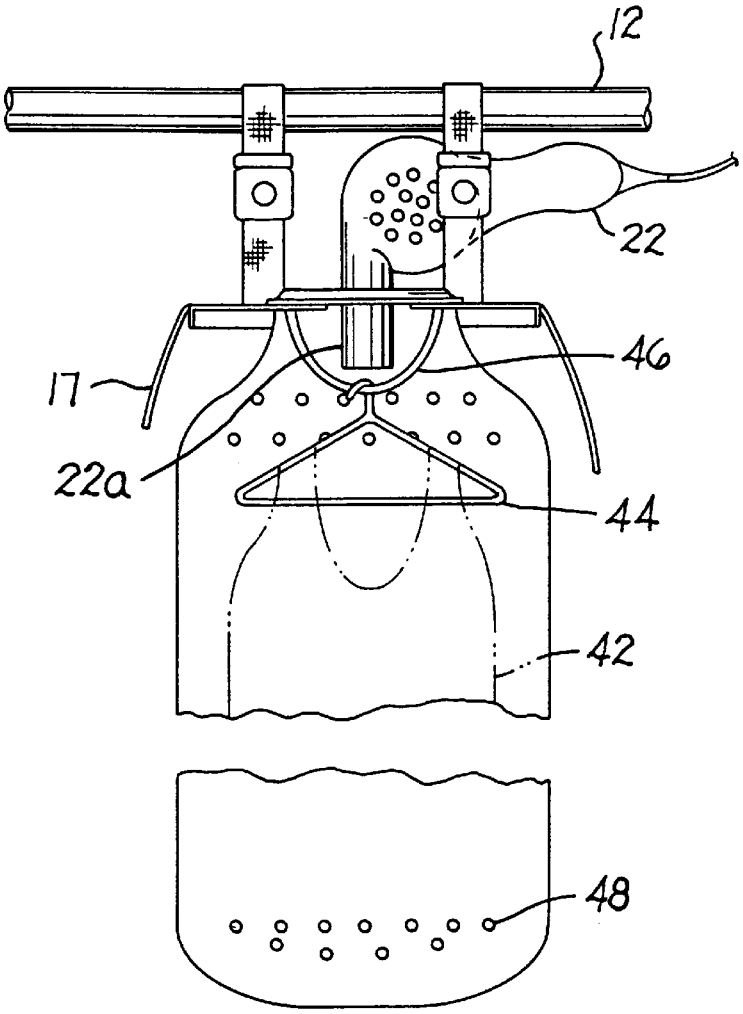
FIG. 5 is a front view of the garment dryer of the present invention hanging from a rod with the garment bag hanging free and a hair dryer unit with its barrel inserted into the interior of the garment bag.
Figure 6:
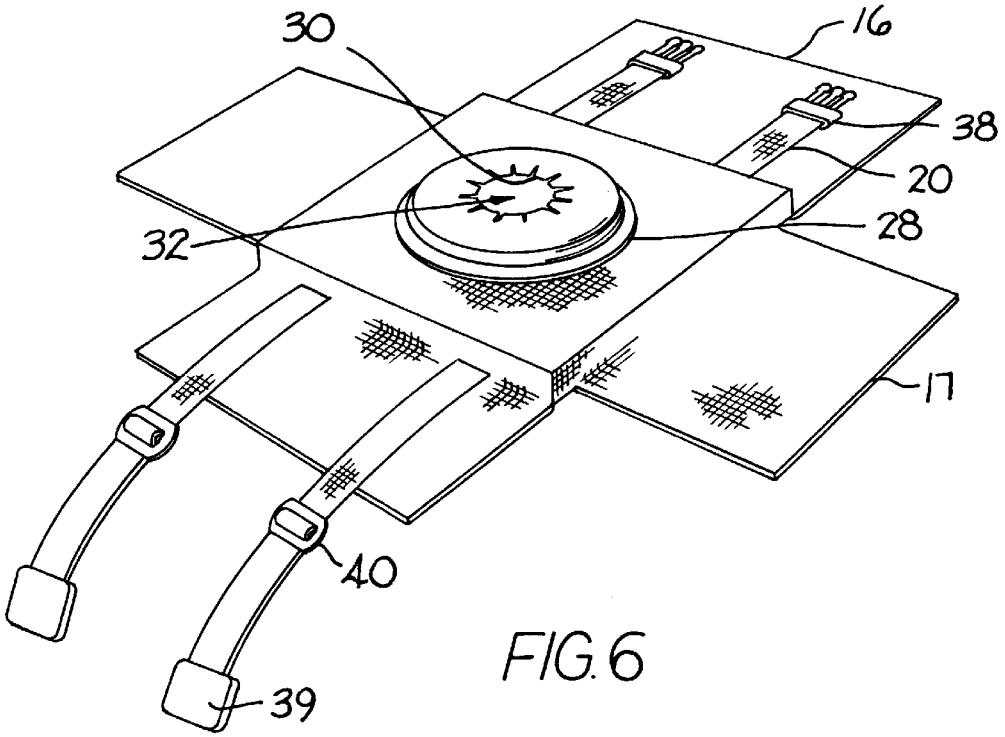
FIG. 6 is a top perspective view of the garment dryer of the present invention with flaps in the open position.

The perspective of FIG. 5 illustrates a garment 42 positioned inside bag 24 and hanging on a hanger 44 itself hooked over a cord 46. The ends of cord 46 are fixed to base member 14 and is sufficiently long enough to permit the garment to be hung several inches below the end of barrel 22*a*. The top open end (not shown) of bag 24 is attached, preferably by stitching to fabric 34, to the undersurface of base 14 and circumscribes opening 26. To allow hot air to effectively circulate about garment 42, bag 24 is provided with a plurality of air vents or perforations 48 at both the top and bottom thereof.

Figure 8:
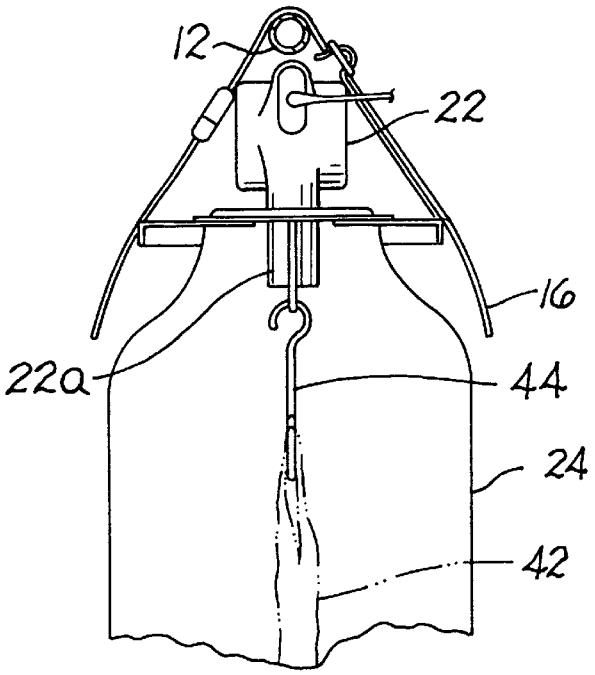
FIG. 8 is a side view of the garment dryer shown in FIG. 5 showing the stabilizing abutment of the straps against the dryer unit.

One of the distinct advantages of the present invention is the positioning of the hair dryer unit 22 above and out of direct contact with the garment bag 18. Otherwise, the direct heat of the unit and reactive forces due to the jet of hot air pushed out of the unit could deleteriously affect the garment bag 24, which must be very light and flexible for packaging. The direct support provided to unit 22 by base member 14 minimizes such destructive effects. However, to further stabilize unit 22, particularly during operation, one set of straps 20 abut the body of the hair dryer unit 22 as shown in FIG. 8. This further stabilization assures the essentially complete immobilization of the unit 22 and permits the unattended operation of the dryer 10.

Figure 7:
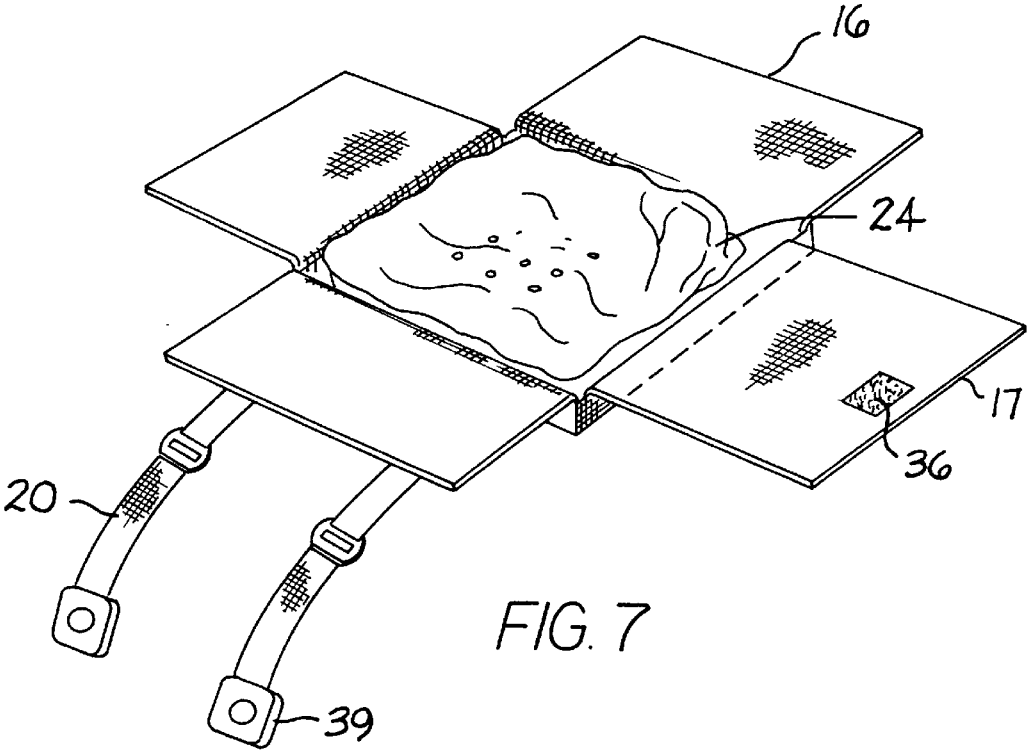
FIG. 7 is a bottom perspective view of the garment dryer of the present invention with the garment bag folded into a flat configuration and with the flaps in the open position.

When the dryer 10 is not being used, garment bag 24 may be tightly folded in a flat configuration against the bottom surface of base 14 as depicted in FIG. 7. Flaps 16 are then closed against the folded garment bag 24 and flaps 17 secured in the manner illustrated in FIG. 3. As stated above, the straps 20 are shortened and fastened about the shut flaps providing additionally security and a convenient handle for carrying the dryer 10. Because of the compact and light nature of the dryer, it can easily be carried and placed in suitcases and the like for traveling.

Figure 9:
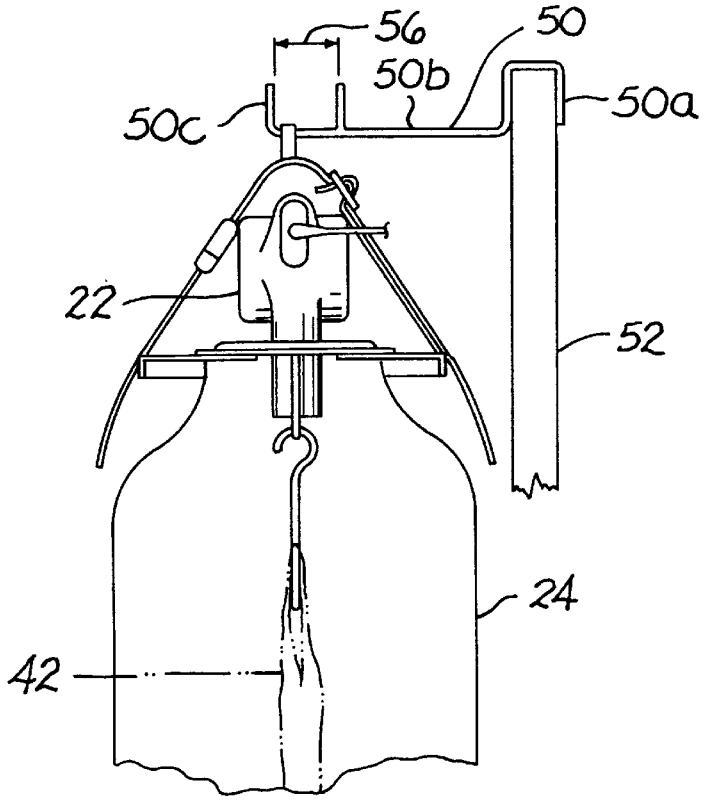
FIG. 9 is a view like FIG. 8 with an attachment structure permitting the dryer to be hung from the top edge of a door.
Figure 10:
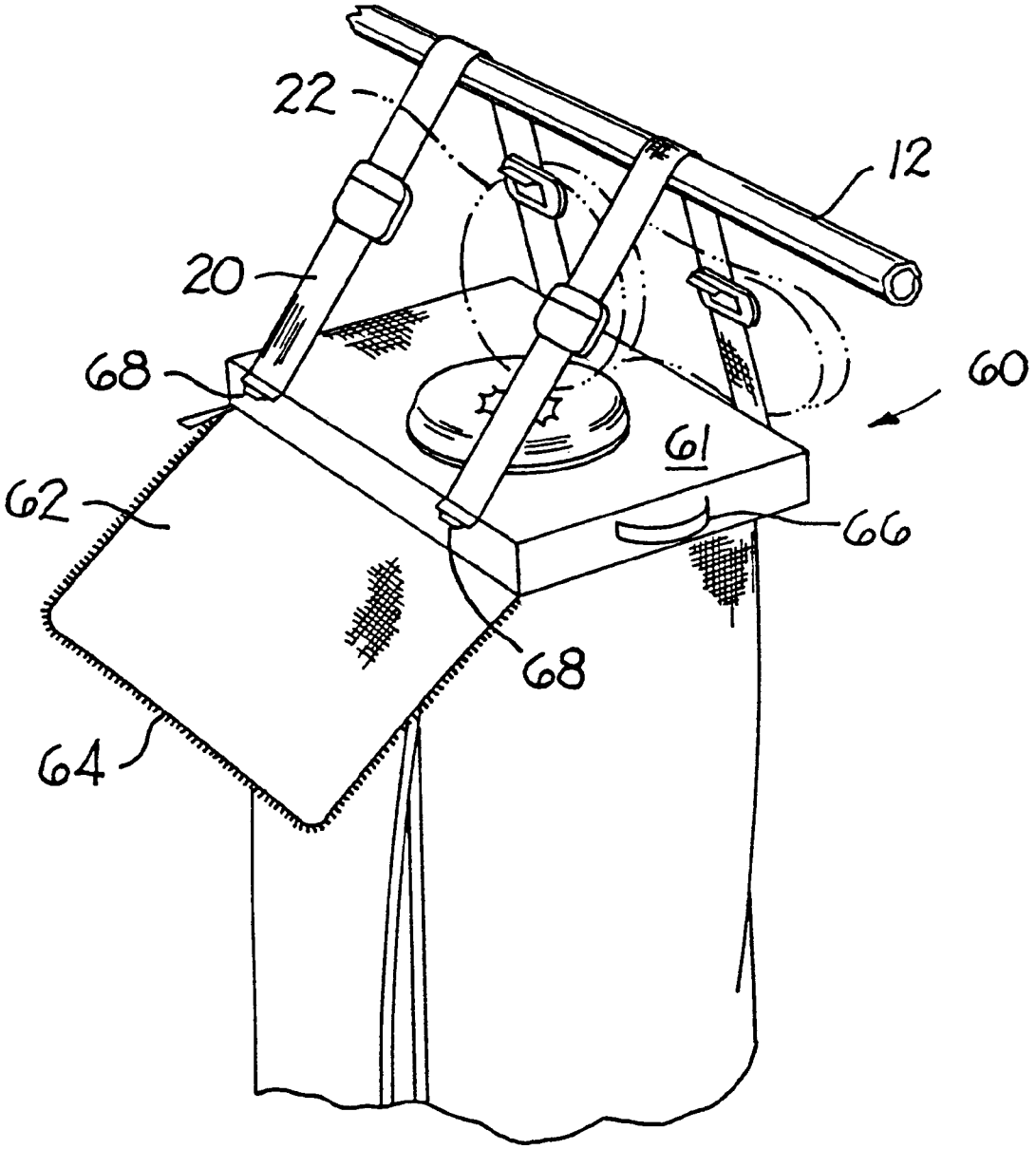
FIG. 10 is a perspective view of an alternative embodiment in which the garment dryer is a self contained carrying case into which the garment bag and straps are folded when not in use.
Figure 11:
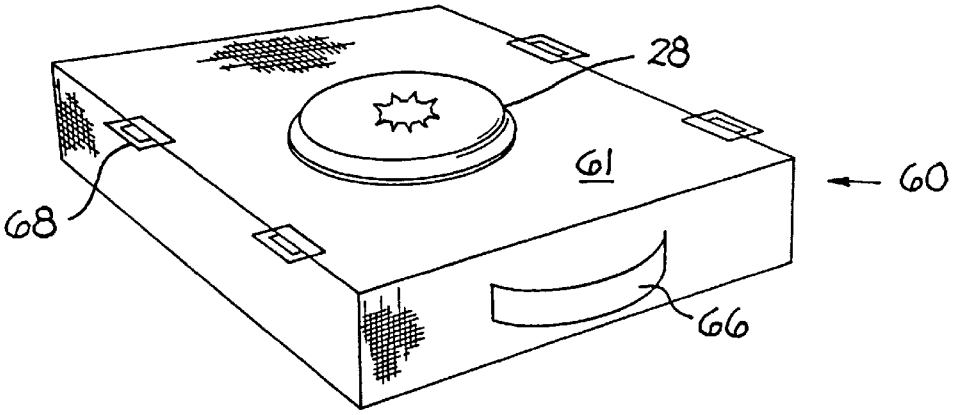
FIG. 11 is a perspective view of the carrying case in FIG. 10 when the garment bag is not in use.
Figure 12:
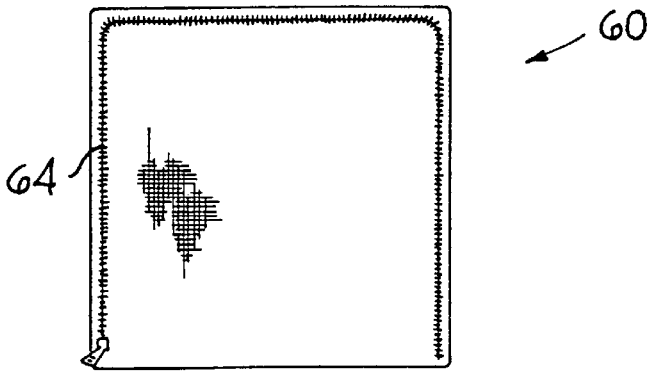
FIG. 12 is a bottom view of the carrying case of FIG. 11.
Figure 13:
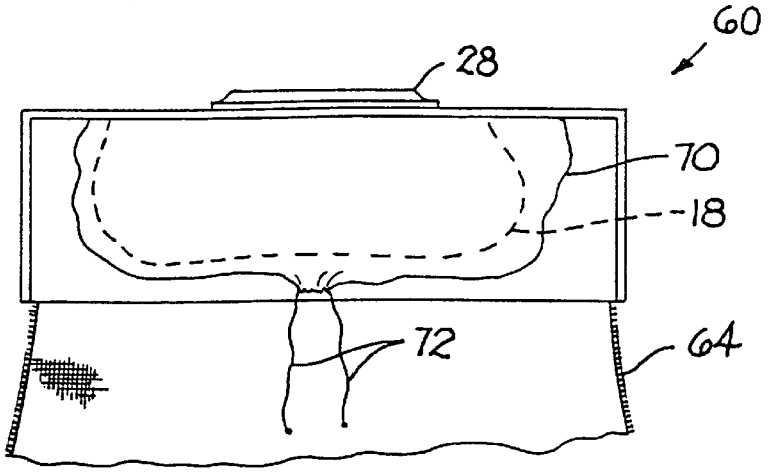
FIG. 13 is a side view of the carrying case with the bottom flap unzippered showing the folded bag inside of the carrying case.

In many instances, the motel or hotel room may not have a closet pole or shower curtain rod that is available or convenient to use. To facilitate use of the dryer in such situations, an attachment that could use available doors would be desirable. The view of FIG. 9 illustrates such an attachment in the form of a pair of support member 50, each to be associated with one of the straps 20. Only one of the support members 50 can be seen in the side view of FIG. 9. Each support member 50 comprises a pair of U-shaped brackets 50*a* and 50*c* spaced by a straight portion 50*b*. Inverted bracket 50*a* is illustrated as cupping the top edge of door 52. Although not shown, the second support member 50 associated with the other strap 20 is spaced an appropriate distance along the door edge from the first support member 50. An upright U-shaped bracket 50*c* integral with the other end of extension portion 50*b* hooks through a loop 50 in the associated strap 20. The extension portion 50*b* permits the bag 24, even when in an inflated condition due to the circulation of the hot air, to hang substantially free from abutment with the door 52. To accommodate doors of greater than standard thickness (about 1¼ inches to 1⅝ inches), bracket 50*c* is provided with a greater width shown by arrow 56 and can be used to cup the top edge of such doors while bracket 50*a* can be used to hook through the loops 54 in straps 20. When the support members 50 are not being used, they may be stored, for example, in closable pockets 58 depicted in FIG. 1.

Figure 14:
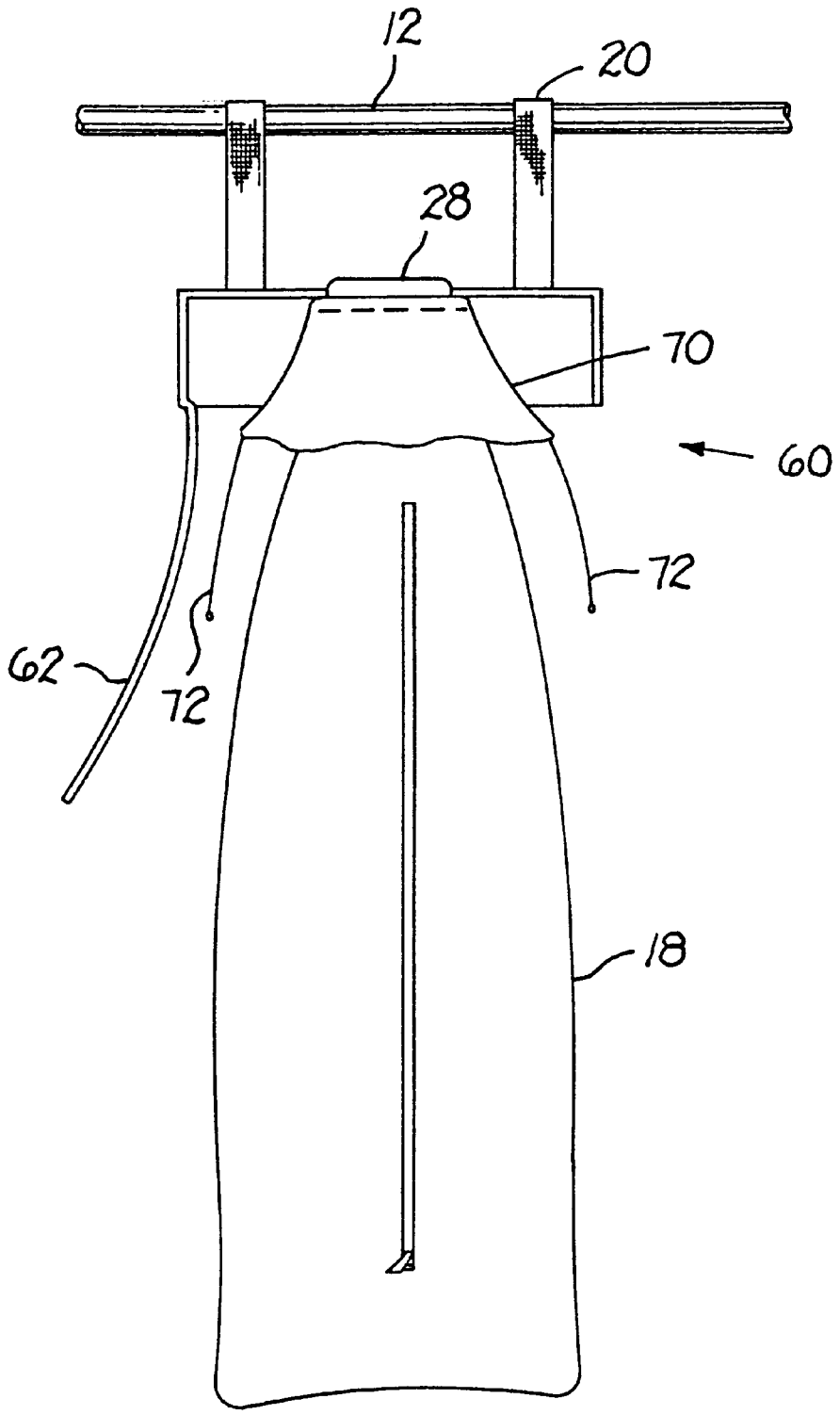
FIG. 14 is a side view of the embodiment of FIG. 10 showing an enclosing grommet bag for the garment bag.

An another embodiment is illustrated in FIGS. 10–14. The dryer unit is depicted generally by character numeral 60 in which the unit has the shape of a container with a single flap 62 forming the bottom of the container. Top wall 61 defines the opening 26. Flap 62 may be secured to the container as a bottom thereof by a zipper 64 or other fastening devices as desired. Straps 20 are snapped or secured to the container at snaps 68 and when not in use may be stored with dryer unit 60. The dryer unit 60 also is provided a carrying handle 66 along one side thereof. As perhaps best illustrated in FIGS. 13 and 14, a storage bag 70 with draw strings 72 may be secured to the bottom surface of the top of unit 60 about the opening 26 or, for example, as shown in FIG. 14, provided with an elastic upper mouth that removably fits around a downwardly protruding rim of member 28. In either construction the purpose of storage bag 70 is to store the garment bag 18 against the underneath surface of top wall 61 when not in use.

From a reading of the foregoing, it should be clear that the various materials may be used for the plate acting as a base member 14 and the garment bag 24. Those set forth were for only for illustrations of examples. Similar the dimensions used are not critical although it is desirable that the size of the plate be kept small to accommodate the portability and the compact nature of the invention. Other and different fasteners can be clearly used. Moreover, the flaps, while described as flexible, could be made of a more rigid material with accommodation being made for the finite size even in a flat configuration of the garment bag when folded. The opening that receives the barrel of a hair dryer could be lined with an elasticized member, forming an expandable gusset to accommodate changes in the diameter of the hair dryer barrel being used. In the alternative embodiment a single flap that is zippered is shown. However, it is clear that other and different flap configurations may employed as well as securing or fastening devices. Other changes and modifications will become apparent to those with ordinary skill in the art. Thus, it is to be understood that only the preferred embodiment of the invention was disclosed, but it is understood that the such changes and modifications should be interpreted within the scope of the inventive concept as expressed herein.

I claim:

1. A portable garment dryer comprising:

a support member (10, 14, 60) defining an opening (26) therethrough adapted to receive and mount a hair dryer unit (22) adjacent a top surface thereof;

a garment enclosing bag (18) having one open end that is secured to a bottom surface of said support member (10,60) about said opening (26), said garment bag (18) being selectable openable (24) along one side thereof;

a pair of dryer support straps (20), including means for securing the ends thereof together (39) and means for altering the length of said straps (40), adapted to be secured to a support structure (12) and permit said garment enclosing bag (18) to hang free beneath the bottom surface of said support member (10, 14, 60); and means attached to said support member for releasably enclosing said garment bag when not in use (16, 17, 64), said garment bag (18) being made of material sufficiently flexible to permit said garment bag (18) to be folded into a flat configuration against said bottom surface of said support member (10, 14, 60) and enclosed by said enclosing means (16, 17, 64);

wherein the support member is a container (60) having a top wall (61) defining said top and bottom surfaces, said garment bag (18) being folded within said container when not in use.

2. The dryer of claim 1 in which said straps (20) are removable from said container (60) and stored within said container (60) when not in use.

3. The dryer of claim 1 in which said enclosing means is a packaging bag (70) attached to said bottom surface about said opening (26) for receiving and containing said garment bag (18) within said container (60) when not in use.

4. The dryer of claim 1 in which said support member is flat and rigid platen (14) against which said garment bag (18) is folded when not is use.

5. The dryer of claim 4 in which said enclosing means are a plurality of flaps (16, 17) attached to said bottom surface for enclosing said garment bag (18) and said bottom surface when said dryer is not in use.

* * * * *